United States Patent [19]

Hill et al.

[11] Patent Number: 4,915,232

[45] Date of Patent: Apr. 10, 1990

[54] PICNIC MAT AND CARRYING BAG ASSEMBLY

[76] Inventors: David T. Hill, Rt. 4 Box 198; Pamela L. Cass; William E. Cass, III, both of P.O. Box 671, all of Warrenton, Va. 22186

[21] Appl. No.: 354,786

[22] Filed: May 18, 1989

[51] Int. Cl.[4] ..... A47G 9/06; A47G 11/20

[52] U.S. Cl. ..... 206/541; 206/549; 206/494; 5/420

[58] Field of Search ..... 5/417, 418, 419, 420; 206/494, 541, 549, 223

[56] References Cited

U.S. PATENT DOCUMENTS

| | | | |
|---|---|---|---|
| 1,653,246 | 12/1927 | Zichy | 206/223 |
| 2,540,165 | 2/1951 | Fiel | 5/419 X |
| 2,907,057 | 10/1959 | Specht | 5/417 |
| 3,237,904 | 3/1966 | Abruzese | 5/417 X |
| 4,068,786 | 1/1978 | Taniguchi | 5/419 X |
| 4,337,812 | 7/1982 | Trinkner | 206/549 X |
| 4,375,111 | 3/1983 | Hall | 5/420 X |

*Primary Examiner*—William Price

[57] ABSTRACT

The invention disclosed is a picnic mat, multipurpose tote bag and securing means assembly suitable for use by a group of people for picnics and concerts etc. The picnic mat is provided with loops on the underside corners as well as corresponding ground securing devices or pins for holding said mat to the ground. Also provided is a pin manipulating tool to facilitate the insertion in and removal of said pins from the ground without damage to the picnic mat. This invention is also provided with a multipurpose tote bag with an inner pouch for containing said pins and a restraining strap for said manipulating tool.

4 Claims, 8 Drawing Sheets

PICNIC MAT AND CARRYING BAG ASSEMBLY

BACKGROUND OF THE INVENTION

1. Field of the Invention

This invention relates to the field of multipurpose tote bags and picnic mat combinations.

2. Description of the Prior Art

A number of devices have been patented which provide for a bag/mat combination, for example, those described in U.S. Pat. Nos. 4,489,815 and 4,375,111. There have also been a number of devices patented which provide for various pins for holding beach towels down in sand, for example, those described in U.S. Pat. Nos. 2,907,057 and 2,840,092. There have also been devices patented which provide waterproof backing for towels, for example, that described in U.S. Pat. No. 4,278,719. However, the invention herein has never been described. The prior devices do not combine the various aforementioned components to provide a convenient, simple, self contained, comfortable and attractive mat and bag for picnic and concert use etc. Prior devices were obviously useful only to an individual and not to groups. Also prior devices were so complicated to use with pillow attachments, hidden pockets, detachable straps and bags etc that they became undesirable. Again, while many prior devices were useful on beaches and areas that are rocky or pebbled, these devices become unsuitable for use on a lawn. Pins have been provided in prior art that are unsafe in that they protrude above the ground possibly causing someone to stumble. Again prior art shows pins that are too complicated to use easily and conveniently.

DESCRIPTION OF THE INVENTION

It is an object of this invention to provide a picnic mat for the comfort of persons desiring to sit or recline on lawns. Provided is a water-resistant underside along with a multi-layer batting (for comfort), stitched to an attractive topside. With no stitching through all layers, persons using the picnic mat are protected from any moisture on the ground.

Another object of this invention is to provide for the safety of persons desiring to engage in picnics, etc. by providing a loop on the underside corners and corresponding securing devices or pins to push into the lawn means is assured of holding the picnic mat safely in place without allowing said pins to protrude above ground and possibly stumble or scrape any person.

Another object of this invention is to provide a pin manipulating tool for the safe and convenient insertion and removal of said pins into and from the ground without possible injury to the user or unneccesary wear on the picnic mat.

It is further object of this invention to provide convenience of transport by incorporating a multipurpose tote bag which is light weight and simple to use. Said bag would be of convenient size to carry the folded picnic mat as well as small picnic paraphernalia, concert programs, etc. while leaving hands free.

Another object of this invention is to provide a multipurpose tote bag which has a safe and convenient pocket to restrain the ground securing devices when not in use, as well as a restraining strap for storing the pin manipulating tool.

Another object of this invention is to provide an all inclusive storage arrangement for the picnic mat, pins and tool that is durable and of convenient size for the average trunk, closet, etc.

It is a further object of this invention to provide an aesthetically pleasing coordinated mat and bag combination that is convenient, durable and safe.

These and further objects will be explained in the following detailed description and specification.

DETAILED DESCRIPTION OF DRAWINGS

Figure 1:
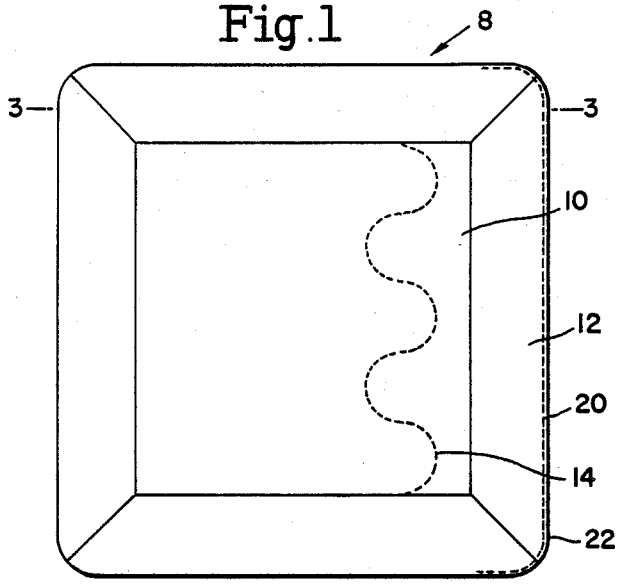
FIG. 1 is a perspective view of the topside of the preferred embodiment in an unfolded condition.

Referring to the drawings in further details, in FIG. 1 the invention is seen to be a picnic mat of a size suitable for several adults. The mat is comprised of a center square 10 of cotton or comparable fabric. Surrounding this square is a border 12 of cotton or comparable fabric.

Throughout the top of the mat are stitches 14 that securely bond the top ply of fabric to the batting. However stitching does not extend through the bottom, water-resistant layer 18 except at the extreme outside edges where stitches extend through all three layers 20. This arrangement allows for the complete comfort of the user by providing completely padded mat whose batting will not shift or collect into uncomfortable or unsightly lumps. At the same time, while the edge stitching through all layers securely bonds all layers, the lack of stitching through all layers throughout the mat prevents moisture on the ground from wicking up through the stitching and making users uncomfortably damp.

Piping 22 is sewn into the seam around the entire perimeter of the picnic mat to allow for greater durability of the mat.

Figure 2:
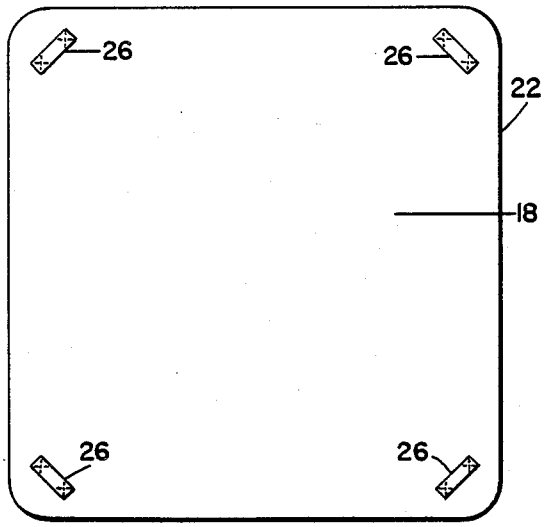
FIG. 2 is a perspective view of the underside of the preferred embodiment in an unfolded condition as well as an enlarged view of the corner details including loops.

FIG. 2 illustrates in perspective the construction of the mat as seen from the under side.

Figure 3:
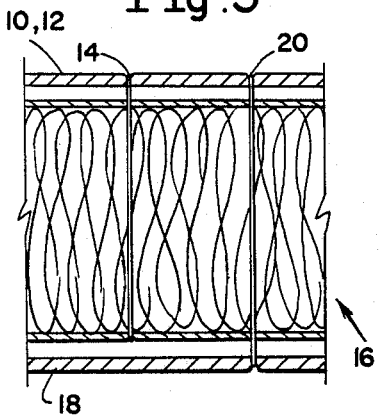
FIG. 3 is a partial, expanded cross-sectional view taken along line 3—3 of FIG. 1.

FIG. 3 illustrates a cross-sectional view taken across line 30—30 in FIG. 1. As shown mat 8 is constructed of a top ply 10,12 of preferably 100% cotton fabric. Middle ply batting 16 is a layer of quilted fabric such as is commonly used in constructing mattress pads. It consists of upper and lower plies of 100% cotton sandwiching a layer of polyester batting between. The bottom ply 18 consists of 100% acrylic fabric which is water, sun and mildew resistant. This arrangement of plies provides for the optimum comfort of the user. It also provides the picnic mat with the proper amount of body to support picnic items, board games etc.

Stitching 20 is provided through all three plies to securely bind some together. Stitching 14 is provided through first and second plies 10, 12 and 16 to allow for optimum comfort while preventing any shifting or lumping of batting 16.

Figure 4:
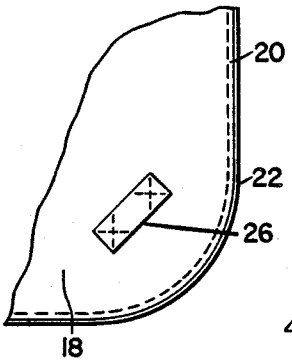
FIG. 4 is an enlarged view of the corner details of the underside of the preferred embodiment.

The picnic mat is readily folded into a compact arrangment which can be disposed within the interior of the bag 36. Said bag is illustrated in FIG. 4. This bag is provided with carrying straps 31 to facilitate transport of the bag 36 and contained picnic mat 8. In the preferred embodiment straps are made from heavy duty nylon strapping. Straps are sewn directly to sides of bag. This allows for extra strength. The open top of the bag 36 has a flap closure 40 that extends over top and down approximately ¾ of front of bag 42. Flap is held securely in closed position by use of hook and loop type fastener 44 such as VELCRO.

Within the interior of the bag is provided a pouch 46 of sufficient size for the containment of pins 50. Pouch 46 is attached to the inside front of bag 42 either by sewing directly to the bag or may be detachable by use of snaps of VELCRO. Open top of pouch 46 is closed by flap 48 with use of snaps or as in preferred embodiment by use of hook and loop type fastener 52 such as VELCRO.

In the interior of the bag on either side is provided a loop 54 sewn at both ends directly to the bag. Said loop is provided for the safe restraint of pin manipulating tool 60 when not in use.

Figure 5:
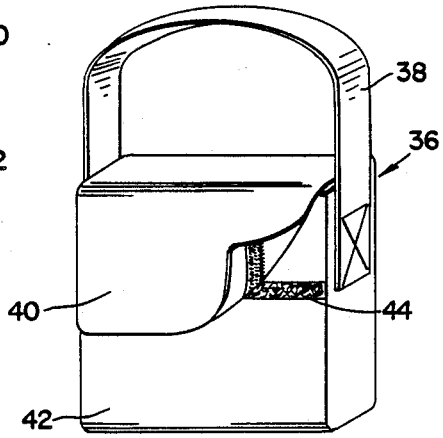
FIG. 5 is a perspective view of the carrying bag in the closed position.

Illustrated in FIG. 5 is a perspective view of the preferred embodiment of the ground securing devices or pins 50 used to secure the picnic mat to the ground. Pins 50 are shaped in an inverted U shape with the top 56 flattened and ends 58 sharpened. Pins 50 are slipped through loops 26 on back of picnic mat 8 and ends 58 are inserted into ground until the top of the pin 56 is flush with the ground. This unique pin and loop arrangement in the preferred embodiment allows for the safe use of the picnic mat 8 by leaving nothing protruding above the ground to be tripped over. This also relieves the users of the inconvenience of having to constantly rearrange the blanket due to wrinkles and folds or the corners getting flipped up, thereby making it difficult to relax and enjoy their picnic, concert etc.

Figure 6:
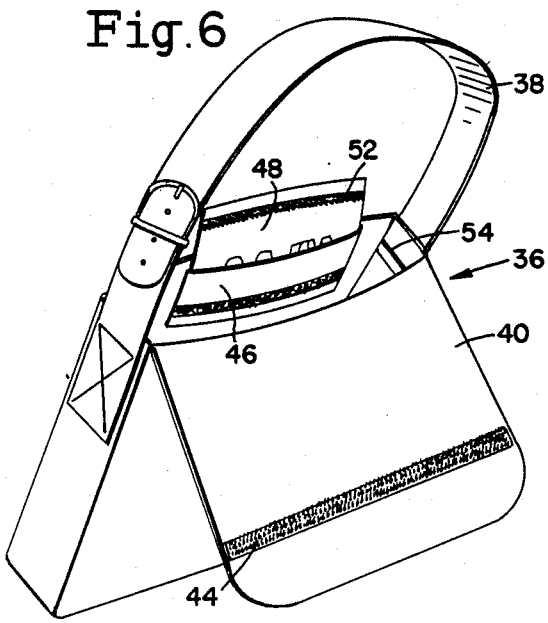
FIG. 6 is an perspective view of the carrying bag in the open position as well as showing a detailed view of the optional buckle arrangement.
Figure 7:
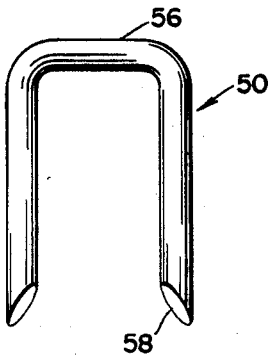
FIG. 7 is a perspective view of the ground securing device or pin used in anchoring the picnic mat to the ground.
Figure 8:
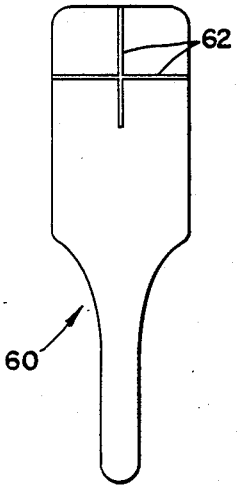
FIG. 8 is a perspective view of the pin manipulating tool used in inserting and releasing ground securing devices or pins.

Also provided is a pin manipulating tool 60 as illustrated in FIG. 6. Tool is used to facilitate the insertion of the pins 50 into the ground thereby preventing the user from injuring their hands on the pins 50. Using the tool also cuts down on wear and tear on the picnic mat 8 corners. The tool 60 is provided with one horizontal and one vertical groove 62 which cross each other at one end of the tool 60. The grooves are of a sufficient size to fit snugly over the top of the pins 56. The overall length of the tool 60 is determined by the length of the side of the bag 36. So that it may be readily contained within, and restrained by loop 54.

It is believed that the present illustration is the best mode and preferred embodiment of this invention. However it is not confined to the details set forth and is intended to include modifications that may extend from following claims.

We claim:

1. A picnic mat, multipurpose tote bag and securing means assembly comprising:

a. a picnic mat constructed of a top ply of woven fabric; a center ply constructed of polyester batting sandwiched between an upper and a lower layer of woven fabric; a bottom ply of acrylic or similar fabric treated to be sun, water and mildew resistant, the top and center plys being stitched together throughout the mat and the bottom ply stitched to the top and center ply around the periphery only; strips of fabric placed diagonally across each corner on the underside of the mat and sewn to form loops;

b. a multipurpose tote bag constructed of acrylic fabric treated to be sun, water and mildew resistant with carrying strap, the bag being of adequate inner volume to contain the mat in a folded position; an inner pouch, means attaching said inner pouch to the bag, a loop, means attaching said loop to the tote bag;

c. ground securing devices or pins in a U shape, of sufficient size to snugly hold said mat loops and allow pin ends to penetrate ground and hold mat; and a pin manipulating tool of appropriate size, to be used to insert and remove pins from the ground.

2. The picnic mat, multipurpose tote bag and securing means assembly as recited in claim 1 wherein said attaching means for said inner pouch consists of any one of snaps, or loops and hook closures, thereby making said pouch removable.

3. The picnic mat, multipurpose tote bag and securing means assembly as recited in claim 1 with the carrying strap on said bag having a buckle arrangement to make said strap adjustable.

4. A picnic mat, multipurpose tote bag assembly comprising:

a. a picnic mat constructed of a top ply of woven fabric; a center ply constructed of polyester batting sandwiched between an upper and a lower layer of woven fabric; a bottom ply of acrylic fabric treated to be sun, water and mildew resistant, the top and center plys being stitched together throughout the mat and the bottom ply stitched to the top and center ply around the periphery only; strips of fabric placed diagonally across each corner on the underside of the mat and sewn to form loops;

b. a multipurpose tote bag constructed of acrylic fabric treated to be sun, water and mildew resistant with carrying strap; the bag being of adequate inner volume to contain the mat in a folded position; an inner pouch, means attaching said inner pouch to the bag, a loop, means attaching said loop to the tote bag.

* * * * *